United States Patent [19]

Pharo

[11] Patent Number: 4,597,244

[45] Date of Patent: Jul. 1, 1986

[54] METHOD FOR FORMING AN INFLATED WRAPPING

[75] Inventor: Daniel A. Pharo, Lodi, Calif.

[73] Assignee: M & D Balloons, Inc., Brisbane, Calif.

[21] Appl. No.: 634,986

[22] Filed: Jul. 27, 1984

[51] Int. Cl.[4] ..... B65B 31/04

[52] U.S. Cl. ..... 53/434; 53/469; 53/512; 206/522

[58] Field of Search ..... 53/432, 433, 434, 469, 53/511, 512; 206/522; 446/220, 222

[56] References Cited

U.S. PATENT DOCUMENTS

| | | | |
|---|---|---|---|
| 2,542,206 | 2/1951 | Nichols | 53/433 X |
| 2,895,270 | 7/1959 | Blaess | 53/432 X |
| 2,994,424 | 8/1961 | Selby et al. | 206/522 X |
| 3,009,498 | 11/1961 | Fohr | 446/222 X |
| 3,461,645 | 8/1969 | Snyder | 53/512 |
| 3,910,009 | 10/1975 | Canfield | 53/512 |
| 4,077,588 | 3/1978 | Hurst | 244/126 X |
| 4,434,893 | 3/1984 | Barlow | 206/522 |

FOREIGN PATENT DOCUMENTS

| | | | |
|---|---|---|---|
| 1444713 | 8/1976 | United Kingdom | 53/434 |

*Primary Examiner*—Fred Silverberg
*Assistant Examiner*—Michael D. Folkerts
*Attorney, Agent, or Firm*—Phillips, Moore, Lempio & Finley

[57] ABSTRACT

A method for forming an inflated gift wrapping includes the insertion of a gift or other item into an open-end of an envelope, at least partially inflating the envelope with an inert gas and thereafter completely sealing the envelope. The envelope is thus formed into an inflated gift wrapping, preferably composed of a pair of overlying panels that are heat-sealed together about their perimeters. In a preferred embodiment of this invention, the packaged item is inserted into a first open-end of the envelope, the first end of the envelope is heat-sealed, the envelope is pressurized with the inert gas through a second and opposite open end thereof, and then the second end of the envelope is heat-sealed to form a fully closed and sealed wrapping.

7 Claims, 4 Drawing Figures

METHOD FOR FORMING AN INFLATED WRAPPING

TECHNICAL FIELD

This invention relates generally to a closed and sealed wrapping and more particularly to an inflated wrapping containing an item, such as a gift, therein and a method for forming the wrapping.

BACKGROUND ART

Conventional Christmas wrappings and the like normally comprise a flat sheet of paper adapted to be wrapped around a gift and held in place by ribbons, gummed stickers, and the like. Other types of wrappings include the use of a bag-like pouch containing a gift and tied at its open upper end by a ribbon or the like. Gift wrappings of this type are susceptible to premature opening and do not insure against the ingress of contaminants therein, such as water. In addition, conventional gift-wrappings normally do not provide a cushioning barrier to protect the contained gift against breakage when the composite gift, including its wrapping, is dropped or otherwise subjected to adverse impact forces.

DISCLOSURE OF INVENTION

This invention overcomes the above, briefly described problems of the prior art by providing a unique inflated wrapping and economical method for expeditiously forming the wrapping.

The method for forming the inflated wrapping comprises inserting an item into an envelope having at least one open end, at least partially inflating the envelope with an inert gas, and sealing the open end of the envelope to form a fully sealed and inflated wrapping containing the packaged item therein.

The thus-formed inflated wrapping preferably comprises a pair of overlying panels in sheet-form and inflated chamber means defined in the envelope and containing the inert gas which exerts an internal pressure therein greater than ambient pressure surrounding the envelope.

BRIEF DESCRIPTION OF THE DRAWINGS

Other objects and advantages of this invention will become apparent from the following description and accompanying drawings wherein.

BEST MODE OF CARRYING OUT THE INVENTION

Figure 1:
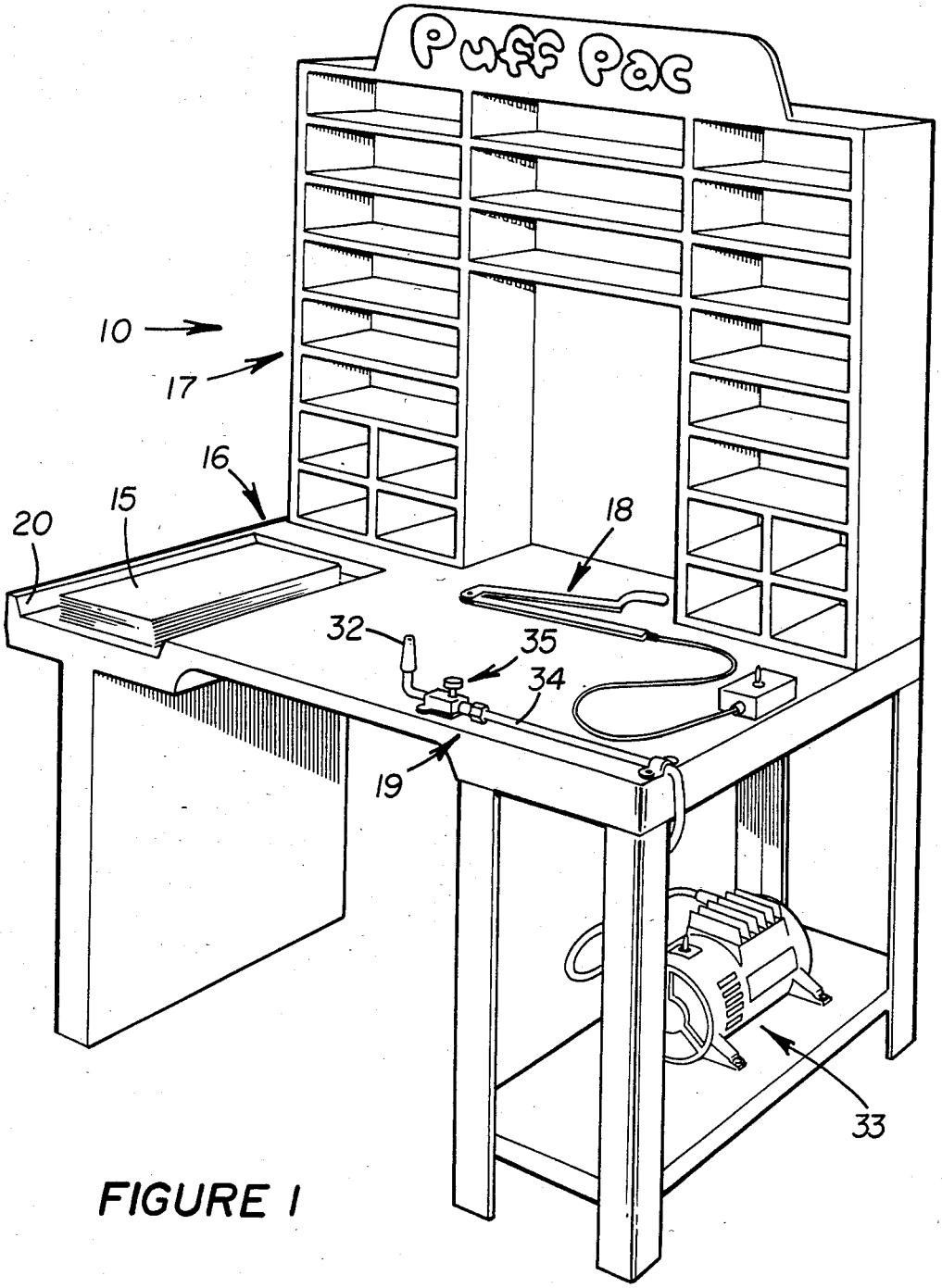
FIG. 1 illustrates a work station for forming an inflated wrapping of this invention.
Figures 2, 3:
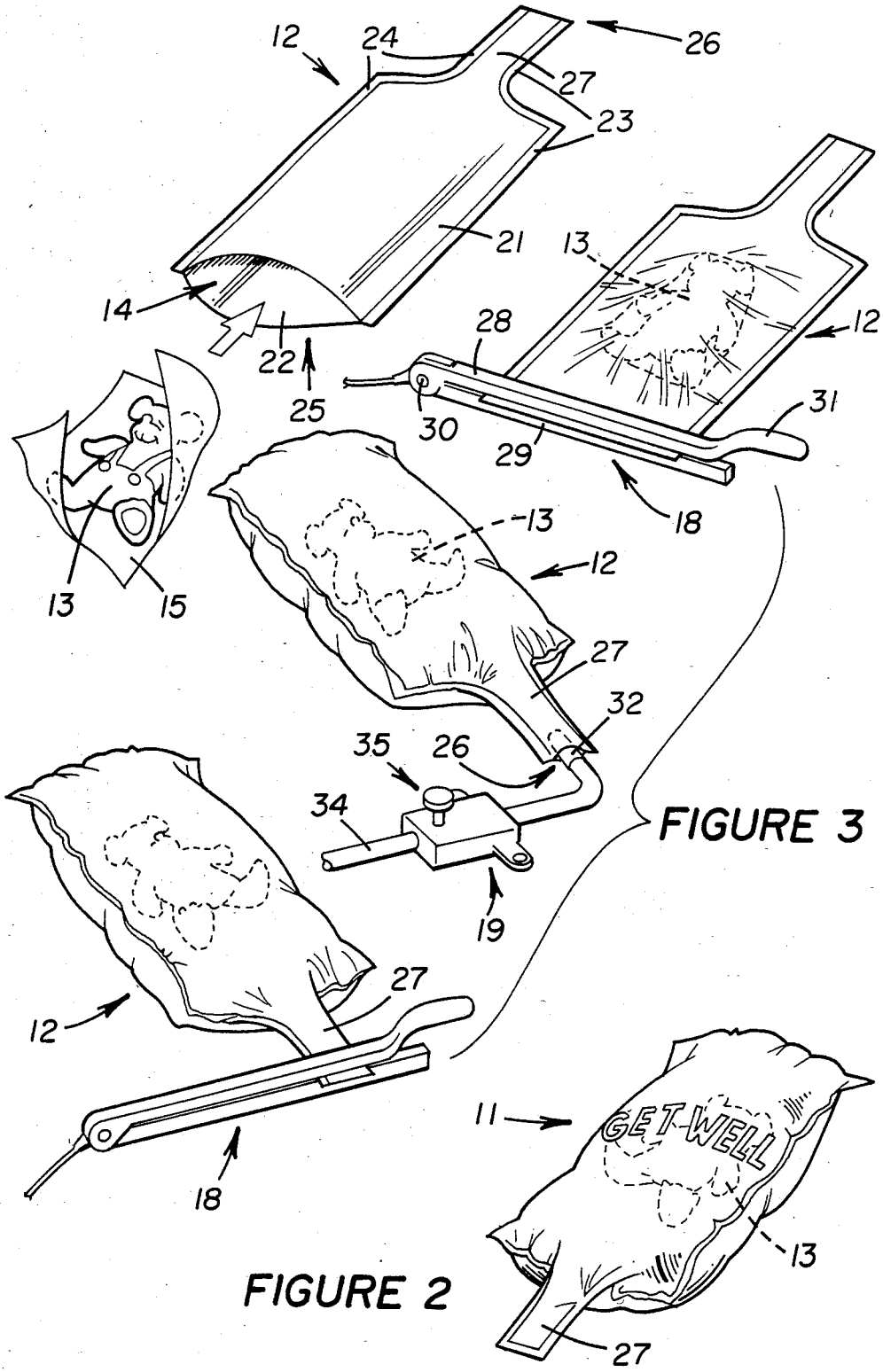
FIG. 2 illustrates the formed inflated gift wrapping, having a gift item retained therein.
FIG. 3 sequentially illustrates method steps for forming the gift wrapping.

FIG. 1 illustrates a work station 10 adapted to form an inflated gift wrapping 11, shown in FIG. 2. The work station may be located in any suitable department store or the like to take the place of a conventional wrapping counter whereat customers normally attend for gift wrapping purposes. Referring briefly to FIGS. 2 and 3, inflated wrapping 11 comprises a heat-sealable envelope 12 having a gift item 13 contained in an inflatable chamber 14 thereof. If so desired, the gift item may be prewrapped with a protective wrapping 15, such as a tissue paper sheet or the like.

Returning to FIG. 1, work station 10 comprises a work table 16 having a storage bin or racks 17 mounted thereon to retain a selected series of envelopes 12, described more fully hereinafter. The work station further includes a standard heat-sealing apparatus 18 adapted to heat seal opposite ends of envelope 12 and an inflation apparatus 19. Apparatus 18 may constitute the impulse table top bag sealer Model 210-8 manufactured by AIN Plastics, Inc. of Mount Vernon, N.Y., for example. The inflation apparatus is adapted to inflate the envelope, prior to its final sealing, with an inert or other type gas, preferably pressurized air. A tray 20 is defined on work table 16 to retain a stack of tissue paper sheets 15 therein.

FIG. 3 sequentially illustrates method steps that may be followed for forming inflated wrapping 11. Envelope 12 may comprise a pair of superimposed and heat-sealable panels 21 and 22 each preferably composed of a composite laminate. For example, each panel may comprise an intermediate layer of aluminum and outer and inner layers of a plastic heat-sealable coating, such as polyethelene, adapted to reactivate (melt) in the range of 300° F. Composite laminates of this type are well-known in the art as being used primarily for metalized balloons and are exemplified by those disclosed in U.S. Pat. No. 4,077,588.

In the preferred embodiment of this invention, panels 21 and 22 are preferably heat-sealed along opposite edges 23 and 24 thereof to define first and second opposite open ends 25 and 26, respectively. First open end 25 is defined substantially across the full width of the envelope to provide a relatively large opening adapted to receive gift item 13 therein. Opposite second open end 26 is formed at the extremity of a stem or neck portion 27 of the envelope which has a width substantially less than the width of the main body of the envelope defining first open end 25.

As further shown in FIG. 3, inflated wrapping 11 is formed by first opening end 25 of envelope 12 and inserting gift item 13 into inflatable chamber 14 thereof. In this embodiment of the invention, heat-sealing apparatus 18 is then used to seal first open end 25 of the envelope. Apparatus 18 may comprise a pair of standard electrically heated sealing bars 28 and 29 pivotally connected together at one end by a pin 30. Bar 28 may have a heat and electrically-insulated handle 31 secured thereon for the purpose of clamping and sealing panels 21 and 22 of the envelope together at end 25 thereof.

Still referring to FIG. 3, a nozzle 32 of inflation apparatus 19 is then inserted into second open end 26 of the envelope to inflate chamber 14 with an inert or other type gas, such as pressurized air or helium. As shown in FIGS. 1 and 3, nozzle 32 may be suitably connected to an air compressor 33 via a conduit 34 having a standard needle valve connected thereto to control the rate of inflation. Chamber 14 is pressurized to exhibit an internal pressure greater than ambient pressure, i.e, at sea level whereat ambient pressure is 14.7 psi, the inflation pressure could be in the range of from 15.0 to 16.0 psi, for example.

After the envelope has been suitably pressurized, stem 27 can be finger-pinched or a suitable sealing clamp (not shown) can be applied to stem 27 to prevent depressurization of the envelope and to ready it for the final sealing operation. The final sealing operation is effected by clamping the stem between heating bars 28 and 29 of heat-sealing apparatus 18 to close and seal second open end 26 of the envelope. Thus, inflated wrapping 11 of FIG. 2 is fully sealed about the periphery thereof.

It should be understood that envelope 12 can be otherwise configured, i.e., circular, triangular, etc. In addition, the envelope could be formed from a single panel or sheet with the sheet being folded transversely over itself to exhibit only one sealed edge or side seam 23 or 24. Furthermore, the envelope could be performed with only one open end, such as open end 25, with the single open end being used for both inserting gift item 13 into the envelope and for inserting nozzle 32 therein for inflating the envelope. For example, in the illustrated configuration of open end 25, the gift item 13 could be inserted into the envelope with such end being thereafter heat-sealed only along a portion of its length to leave a small opening for insertion of nozzle 32 therein. Thereafter and after inflation, heat-sealing apparatus 18 could be again used to heat seal the latter nozzle opening.

Figure 4:
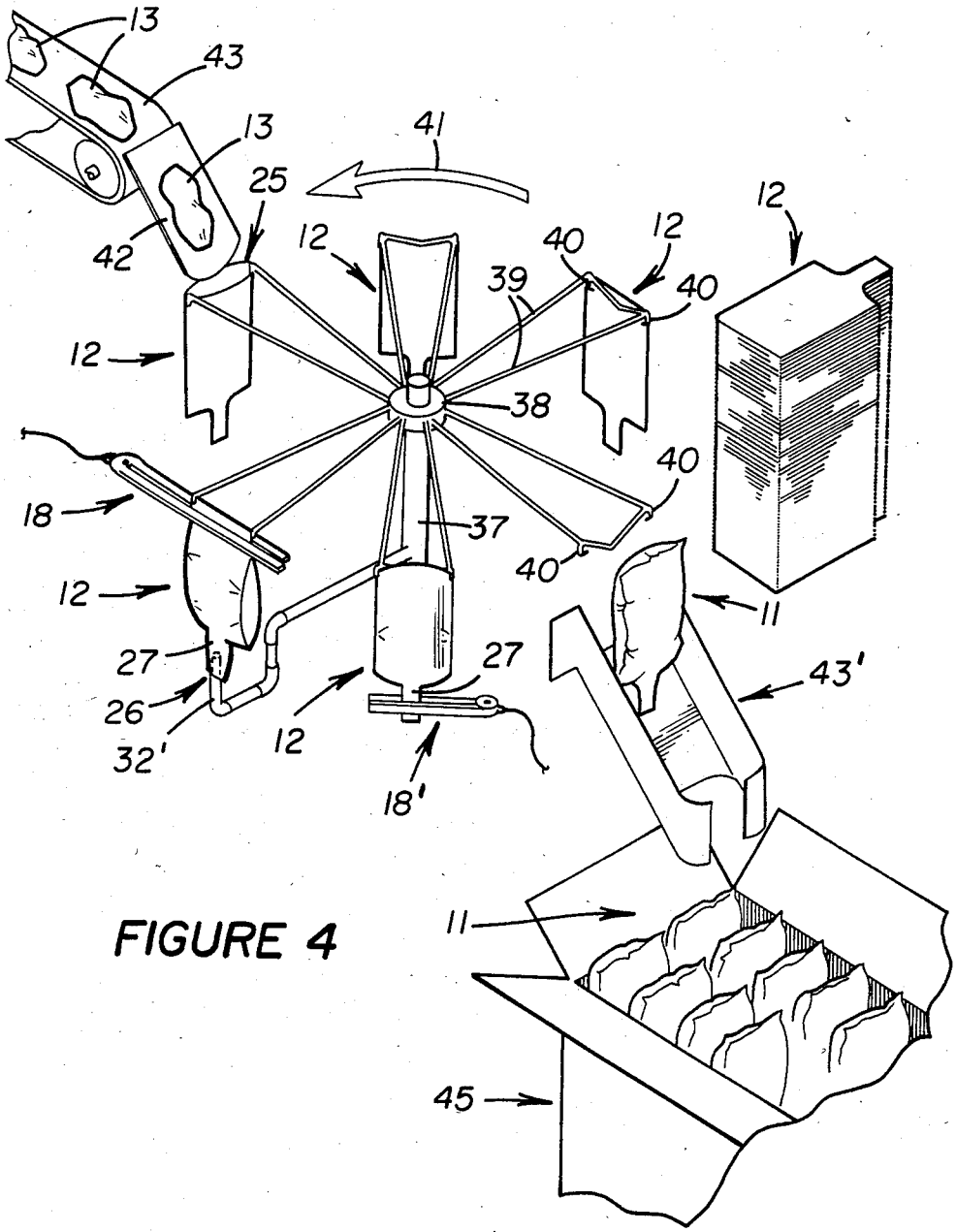
FIG. 4 sequentially illustrates an alternative method and apparatus for forming the inflated gift wrapping of FIG. 2.

FIG. 4 schematically illustrates a carousel-like forming apparatus adapted to form inflated wrapping 11 at a factory facility, for example. Although the method steps illustrated in FIG. 4 are illustrated as being primarily performed by hand, it should be understood to those skilled in the arts relating hereto that such method steps could be automated by use of conventional apparatus and controls.

Forming apparatus comprises an upstanding stationery post 37 having a collar 38 rotatably mounted thereon and adapted to be rotated either manually by hand or by an electric drive motor (not shown). A plurality of pairs of support rods 39 extend radially outwardly from collar 38 and are adapted to move each envelope 12 sequentially through stations whereat the various method steps for forming inflated wrapping 11 are performed. Each support rod 39 has a standard spring clip 40 attached on an end thereof whereby first end 25 of a respective envelope 12 may be detachably held thereon, as shown in FIG. 4.

After a particular envelope has been suitably attached between a pair of rods 39, collar 38 is intermittently rotated in the direction of an arrow 41 (generally counter-clockwise in FIG. 4) to dispose an envelope beneath a chute 42 for dispensing or inserting gift item 13 into first open end 25 of the envelope, as illustrated. The chute cooperates with an intermittently run conveyor 43 for this purpose. Cantilevered rods 39 may be constructed of steel and exhibit sufficient resiliency whereby an operator can pinch the rods toward each other to open the first end of the bag for receiving item 13 therein.

Collar 38 thereafter rotates to its next station at heat sealing apparatus 18 whereby the first end of the envelope is sealed in generally the same manner described above. After sealing, an air nozzle 32' is inserted into second open end 26 of the envelope in stem 27 to pressurize the envelope in the manner described. After removal of the nozzle, stem 27 is pinched or clamped to prevent deflation and collar 38 again rotates the envelope to its next station whereat a second heat-sealing apparatus 18' seals the second open end of the envelope. The collar thereafter rotates the fully closed and sealed inflated wrapping 11 to its next station whereat the wrapping is released from clips 40 to deposit the wrapping into a transfer trough 43' for further deposit into a corrugated shipping case 45.

As suggested above, although the method and inflated wrapping of this invention are particularly adapted for the wrapping of gifts and the like, other items can be packaged therein. For example, certain frangible items may be suitably wrapped with a protective covering and packaged into air-inflated envelope 12 which is formed in the manner described above to provide substantial cushioning of such item during transit. Other applications of this invention should be apparent to those skilled in the arts relating hereto.

I claim:

1. A method for forming an inflated wrapping from a preformed envelope having a pair of superimposed panels forming a tubular body defining a first open end extending at least substantially across the full width thereof and a stem having a width substantially less than the width of said body and terminating at a second open end sized to receive a nozzle therein, comprising the steps of inserting an item through said first open end and into said envelope, sealing said first open end, inserting said nozzle into said second open end and said stem, at least partially inflating said envelope with a pressurized gas injected through said nozzle, and sealing the second open end of said envelope and said stem to form a fully sealed and inflated wrapping containing said item therein.

2. The method of claim 1 further comprising the step of wrapping said item with a protective sheet prior to said inserting step.

3. The method of claim 1 wherein said inflating step comprises internally pressurizing said envelope with a pressure greater than ambient pressure.

4. The method of claim 3 wherein said inflating step comprises internally pressurizing said envelope with air at a pressure greater than 14.7 psi.

5. The method of claim 1 wherein said envelope is internally coated with a heat-sensitive adhesive and wherein each of said sealing steps comprises heat-sealing the first and second open ends of said envelope.

6. The method of claim 5 further comprising the step of attaching said envelope on a rotary-forming apparatus and intermittently rotating said forming apparatus to sequentially perform said inserting, inflating and heat-sealing steps.

7. The method of claim 1 further comprising preforming said envelope by superimposing a pair of heat-sealable panels over each other and heat-sealing said panels together to define said body, said stem, and said first and second open ends.

* * * * *